US011487220B1

(12) United States Patent
Kawasumi et al.

(10) Patent No.: US 11,487,220 B1
(45) Date of Patent: Nov. 1, 2022

(54) DEVELOPING DEVICE AND IMAGE FORMING APPARATUS INCLUDING IHE SAME

(71) Applicant: KYOCERA Document Solutions Inc., Osaka (JP)

(72) Inventors: Takuya Kawasumi, Osaka (JP); Masakazu Uehara, Osaka (JP); Rei Yamagishi, Osaka (JP); Hiroaki Kitagawa, Osaka (JP); Seia Fujii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/702,512

(22) Filed: Mar. 23, 2022

(30) Foreign Application Priority Data

Apr. 27, 2021 (JP) ..... JP2021-074701

(51) Int. Cl.
*G03G 15/08* (2006.01)

(52) U.S. Cl.
CPC ..... *G03G 15/0817* (2013.01); *G03G 15/087* (2013.01); *G03G 15/0881* (2013.01); *G03G 15/0894* (2013.01); *G03G 15/0898* (2013.01); *G03G 2215/00991* (2013.01); *G03G 2221/1648* (2013.01)

(58) Field of Classification Search
CPC ..... G03G 15/0817; G03G 15/087; G03G 15/0881; G03G 15/0894; G03G 15/0898; G03G 2215/00991; G03G 2221/1648
See application file for complete search history.

(56) References Cited

U.S. PATENT DOCUMENTS

2006/0024085 A1* 2/2006 Sato ..... G03G 15/0812 399/103
2016/0041501 A1* 2/2016 Shoji ..... G03G 15/0881 399/103

FOREIGN PATENT DOCUMENTS

JP 2010-164736 A 7/2010
JP 2021-074703 A * 4/2021

* cited by examiner

*Primary Examiner* — Joseph S Wong
(74) *Attorney, Agent, or Firm* — Stein IP, LLC

(57) ABSTRACT

A developing device includes a developing container, a developer carrier, a seal member, and a pair of pressing members. The developing container has an opening. The seal member includes a contact end part that makes contact with an entire region of an outer circumferential surface of the developer carrier in its rotary shaft direction and is one of end edges of the seal member in a longitudinal direction thereof on a side near the developer carrier and an interposed end part that is interposed between each of both end parts of the developer carder and a corresponding one of the pressing members and is an end edge of the seal member orthogonal to the contact end part, and a chamfered shape is formed at a corner between the contact end part and the interposed end part.

6 Claims, 6 Drawing Sheets

DEVELOPING DEVICE AND IMAGE FORMING APPARATUS INCLUDING IHE SAME

INCORPORATION BY REFERENCE

This application is based upon and claims the benefit of priority from the corresponding Japanese Patent Application No. 2021-074701 (filed on Apr. 27, 2021), the entire contents of which are incorporated herein by reference.

BACKGROUND

The present disclosure relates to a developing device and an image forming apparatus including the same.

An image forming apparatus using an electrophotographic method, such as a copy machine, a printer, a facsimile, or a multi-functional peripheral having functions thereof, includes a developing device for forming a toner image (a developer image) by developing an electrostatic latent image formed on an outer circumferential surface of an image carrier, namely, by visualizing the electrostatic latent image.

The developing device includes a developing container and a developer carrier that is disposed in contact with or adjacently to an image carrier and carries a developer. The developing container contains the developer including a toner. The developing container has a container opening that is open to a downstream side of the developing device with respect to a moving direction of the developing device. The developer carrier is disposed in contact with or adjacently to the image carrier. The developer carrier carries, on an outer circumferential surface thereof, the developer (a toner) in the developing container.

The developer carrier is disposed so as to overlap the container opening. A part of the developer carrier is exposed to an outer side of the developing device through the container opening. The toner in the developing container is supplied from this exposed part of the developer carrier to the image carrier.

As such a developing device, there is a type including a sheet-shaped seal member provided at a gap between a lower part of the outer circumferential surface of the developer carrier and a lower edge part of the container opening. The seal member is disposed on an inner surface of the developing container along a rotary shaft direction (a longitudinal direction) of the developer carrier. The seal member closes the gap between the lower part of the outer circumferential surface of the developer carrier and the edge part of the container opening, thus suppressing an outflow of the developer through the gap.

Furthermore, a pair of pressing members is provided at respective gaps between both end parts of the developer carrier in the rotary shaft direction and the developing container. The pressing members protrude from the inner surface of the developing container toward the outer circumferential surface of the developer carrier so as to make contact with and press the outer circumferential surface of the developer carrier at the both end parts thereof. The pressing members make contact with and press the outer circumferential surface of the developer carrier in this manner, thus closing the gaps between the developing container and the developer carrier to suppress outflow of the developer. Both end parts of the above-described seal member along the rotary shaft direction are interposed in respective gaps between the pressing members and the developer carrier.

SUMMARY

A developing device according to one aspect of the present disclosure includes a developing container, a developer carrier, a seal member, and a pair of pressing members. The developing container has an opening and contains inside a developer including a toner. The developer carrier is rotatably supported to the developing container and has an outer circumferential surface carrying the developer, a part of the outer circumferential surface being exposed through the opening. The seal member is disposed along a rotary shaft direction of the developer carrier and closes a gap between the developer carrier and the opening. The pair of pressing members makes contact with both end parts of the developer carrier in the rotary shaft direction and the seal member so as to close respective gaps between the both end parts of the developer carrier and the developing container. The seal member includes a contact end part that makes contact with an entire region of the outer circumferential surface of the developer carrier in the rotary shaft direction and is one of end edges of the seal member in a longitudinal direction thereof on a side near the developer carrier and an interposed end part that is interposed between each of the both end parts of the developer carrier and a corresponding one of the pressing members and is an end edge of the seal member orthogonal to the contact end part, and a chamfered shape is formed at a corner between the contact end part and the interposed end part.

DETAILED DESCRIPTION

Figure 1:
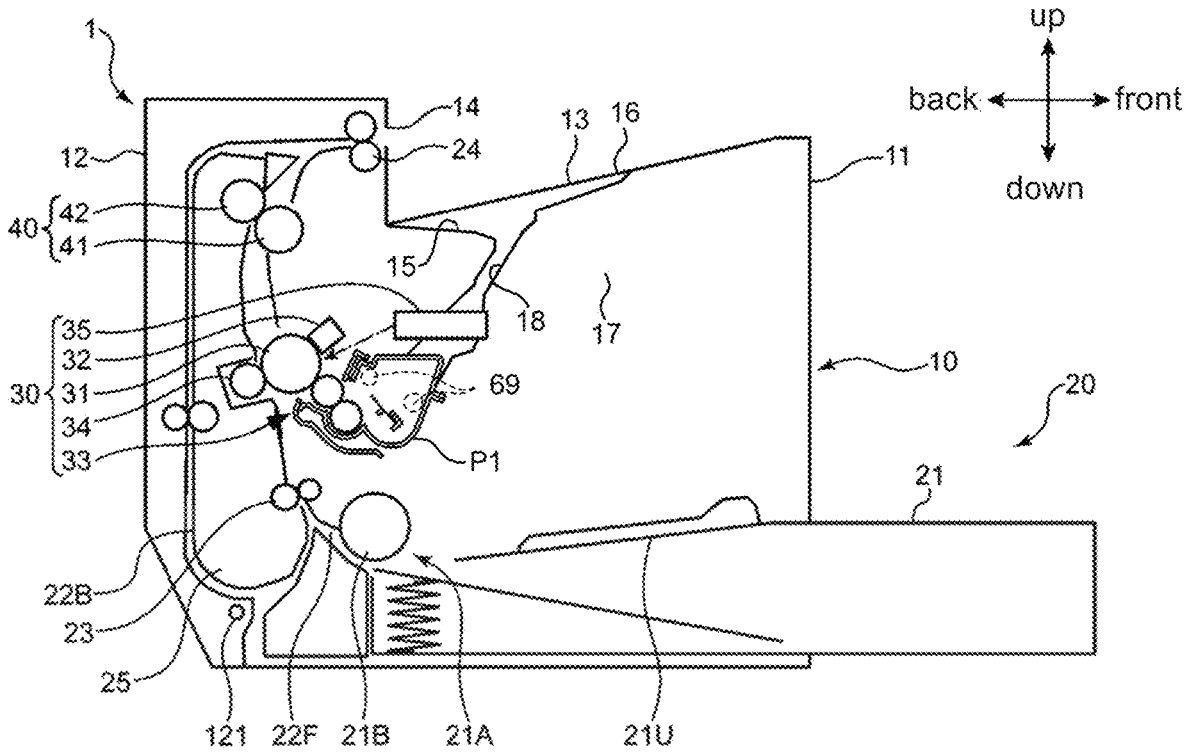
FIG. 1 is a side sectional view showing a schematic configuration of an image forming apparatus of the present disclosure.

With reference to the appended drawings, the following describes an embodiment of the present disclosure. FIG. 1 is a side sectional view showing a schematic configuration of an image forming apparatus 1 of the present disclosure. In FIG. 1, a right side in the figure corresponds to a front side of the image forming apparatus 1, and a left side in the figure corresponds to a rear side of the image forming apparatus 1. Furthermore, in FIG. 1, an upper side in the figure corresponds to an upper side of the image forming apparatus 1, and a lower side in the figure corresponds to a lower side of the image forming apparatus 1.

As shown in FIG. 1, the image forming apparatus 1 (herein, a monochrome printer) includes a main body housing 10 (an apparatus main body), a paper feed portion 20, an image forming portion 30, a developing device 33, and a fixing portion 40, The main body housing 10 has a substantially rectangular parallelepiped-shaped housing structure. The paper feed portion 20 is housed in the main body housing 10.

In the main body housing 10, a front cover 11, a rear cover 12, a main body opening 15, and an upper cover 16 are provided. The front cover 11 is positioned on a front surface side of the main body housing 10. The rear cover 12 is positioned on a rear surface side of the main body housing 10. The main body opening 15 is formed on an upper side in the main body housing 10. The upper cover 16 is provided on an upper surface of the main body housing 10, The upper cover 16 is used to enable opening and closing of the main body opening 15. When the upper cover 15 is opened, there is provided access to inside the main body housing 10 through the main body opening 15.

On an upper surface of the upper cover 16, a paper discharge portion 13 is provided to which a sheet (a recording medium) after being subjected to image formation is discharged. At an upper part of the main body housing 10, a paper discharge port 14 is provided to be opposed to the paper discharge portion 13 in a front-rear direction. The paper discharge port 14 is an opening communicating with an inside of the main body housing 10. In the following description, the term "sheet" refers to a copy sheet, coated paper, an OHP sheet, a cardboard, a postcard, tracing paper, or any other sheet material to be subjected to image forming processing.

In a state where the upper cover 16 is opened, the developing device 33 is removable and insertable through the main body opening 15. In a state where the rear cover 12 is opened, various units (other than the developing device 33) included in the image forming portion 30 and the fixing portion 40 are removable and insertable from the rear surface side of the main body housing 10.

The paper feed portion 20 includes a paper feed cassette 21. The paper feed cassette 21 contains sheets to be subjected to image forming processing. A part of the paper feed cassette 21 protrudes forward beyond a front surface of the main body housing 10. An upper surface of the other part of the paper feed cassette 21 housed in the main body housing 10 is covered with a paper feed cassette top plate 21U.

In the paper feed cassette 21, a sheet containing space for containing a stack of sheets therein, a lift plate for lifting the stack of sheets so as to feed the sheets, and so on are provided. A sheet feed-out part 21A is provided at an upper part of the paper feed cassette 21 on a rear end side thereof. In the sheet feed-out part 21A, there is disposed a paper feed roller 21B for feeding out one by one a topmost one of the stack of sheets in the paper feed cassette 21.

The image forming portion 30 performs an image forming operation. The image forming operation refers to an operation of forming a toner image (a developer image) on a sheet fed out from the paper feed portion 20. The image forming portion 30 includes, in addition to a photosensitive drum 31, a charging portion 32, an exposure portion 35, the developing device 33, and a transfer roller 34, which are disposed around the photosensitive drum 31. As a developer used for image formation, there is used a non-magnetic single-component developer formed only of a toner.

The photosensitive drum 31 (an image carrier) includes a rotary shaft and an outer circumferential surface that rotates about the rotary shaft. On the outer circumferential surface of the photosensitive drum 31, there is formed a photosensitive layer that is made of, for example, a known organic photoconductor (OPC) and composed of an electric charge generation layer, an electric charge transport layer, and so on. The photosensitive layer is uniformly charged by the after-mentioned charging portion 32, after which light is applied thereto by the exposure portion 35 so that an electrostatic latent image with attenuated electrostatic charge is formed thereon, which is then visualized by the developing device 33 into a toner image, and thus the toner image is carried on the photosensitive layer.

Figure 3:
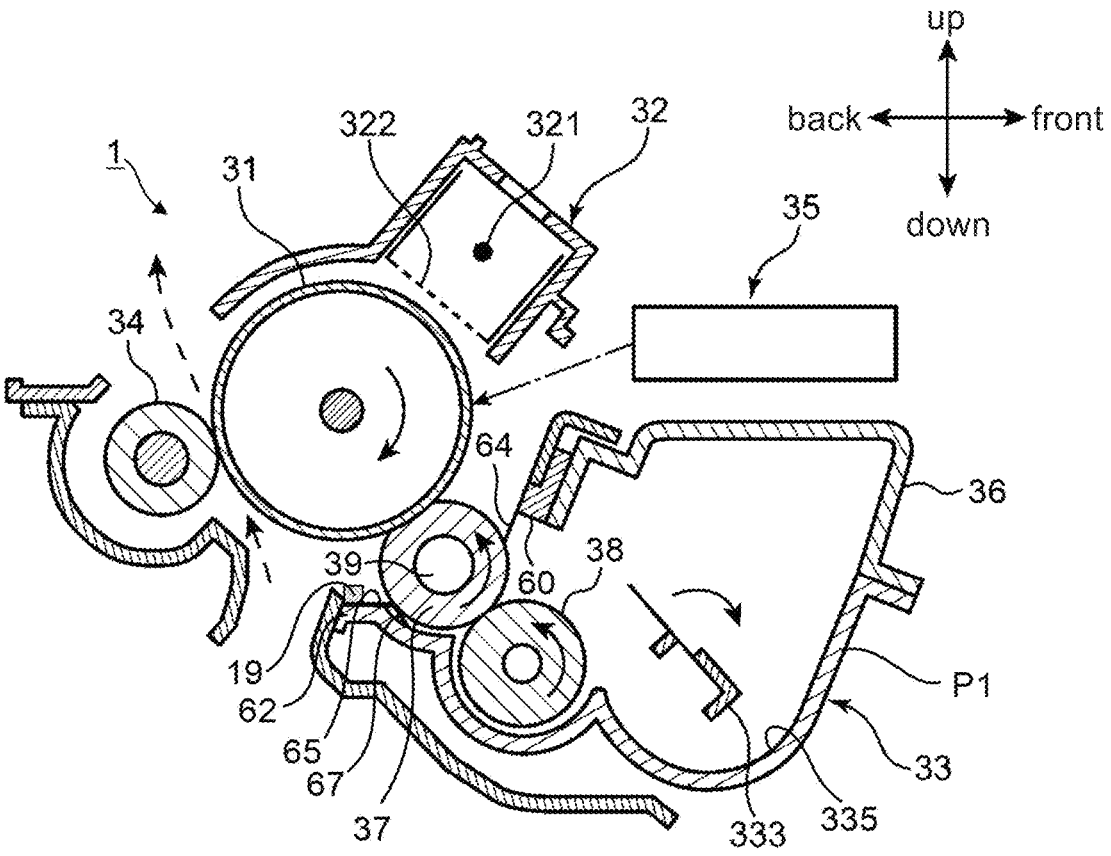
FIG. 3 is an enlarged sectional view showing, on an enlarged scale, a periphery of a photosensitive drum and the developing device.

The charging portion 32 (a charging device) is disposed at a prescribed distance from the outer circumferential surface of the photosensitive drum 31 and uniformly charges the outer circumferential surface of the photosensitive drum 31 without making contact therewith. Specifically, the charging portion 32 includes a charge wire 321 and a grid electrode 322 (each of which is shown in FIG. 3). The charge wire 321 is a linear electrode that extends in a rotary shaft direction of the photosensitive drum 31 and generates a corona discharge between itself and the photosensitive drum 31. The grid electrode 322 is a grid-shaped electrode that extends in the rotary shaft direction of the photosensitive drum 31 and is arranged between the charge wire 321 and the photosensitive drum 31.

The charging portion 32 passes an electric current having a prescribed electric current value through the charge wire 321 so that a corona discharge is generated, and also applies a prescribed voltage to the grid electrode 322 so that a part of the outer circumferential surface of the photosensitive drum 31 opposed to the grid electrode 322 is uniformly charged to a prescribed surface potential.

The exposure portion 35 (an exposure device) includes a laser light source and optical system equipment such as a mirror and a lens. The exposure portion 35 applies light modulated based on image data given from an external device such as a personal computer to the outer circumferential surface of the photosensitive drum 31. In this manner, the exposure portion 35 forms an electrostatic latent image corresponding to an image based on the image data on the outer circumferential surface of the photosensitive drum 31.

The transfer roller 34 includes a rotary shaft parallel to a sheet width direction and an outer circumferential surface opposed to the outer circumferential surface of the photosensitive drum 31. The transfer roller 34 is supported to the main body housing 10 so as to be rotatable about the rotary shaft. The transfer roller 34 transfers a toner image carried on the outer circumferential surface of the photosensitive drum 31 to a sheet passing through a nip between itself and the outer circumferential surface of the photosensitive drum 31. At the time of the transfer, a transfer voltage of a polarity opposite to that of a toner is applied to the transfer roller 34.

The fixing portion 40 is positioned downstream relative to the transfer roller 34 in a sheet conveyance direction and fixes, on a sheet, a toner image that has been transferred thereon. The fixing portion 40 includes a fixing roller 41 and a pressing roller 42. The fixing roller 41 includes inside a heating source and heats a toner transferred on a sheet to a prescribed temperature. The pressing roller 42 is brought into pressure contact with the fixing roller 41 so as to form a fixing nip between itself and the fixing roller 41. When a sheet on which a toner image has been transferred is passed through the fixing nip, the toner image is heated by the fixing roller 41 and pressed by the pressing roller 42 and thus is fixed on the sheet.

In the main body housing 10, a main conveyance path 22F and a reverse conveyance path 22B are provided. The main conveyance path 22F and the reverse conveyance path 22B are used to convey a sheet. The main conveyance path 22F extends from the sheet feed-out part 21A of the paper feed portion 20 to the paper discharge port 14 via the image forming portion 30 and the fixing portion 40. In a case where double-sided printing is performed on a sheet, the reverse conveyance path 22B is used to convey the sheet whose one side has already been subjected to printing back to an upstream side of the image forming portion 30 in the main conveyance path 22F.

The main conveyance path 22F extends to pass upward from below through the transfer nip formed by the photosensitive drum 31 and the transfer roller 34. Furthermore, a registration roller pair 23 is disposed on an upstream side relative to the transfer nip in the main conveyance path 22F. A sheet is once stopped from being conveyed at the registration roller pair 23 so as to be subjected to skew correction and then is fed out to the transfer nip at prescribed timing for image transfer. A plurality of conveyance rollers for conveying a sheet is disposed in each of the main conveyance path 22F and the reverse conveyance path 22B. A paper discharge roller pair 24 is disposed in the vicinity of the paper discharge port 14.

The reverse conveyance path 22B is formed between an outer side surface of a reversing unit 25 and an inner surface of the rear cover 12 of the main body housing 10. The transfer roller 34 and one of rollers constituting the registration roller pair 23 are mounted to an inner side surface of the reversing unit 25. The rear cover 12 and the reversing unit 25 are pivotable about an axis of a fulcrum 121 provided at their lower ends. At the occurrence of a jam (a paper jam) the reverse conveyance path 22B, the rear cover 12 is opened. At the occurrence of a jam in the main conveyance path 22F or in a case of taking out a unit of the photosensitive drum 31 or the developing device 33 to the outside, in addition to the rear cover 12, the reversing unit 25 is also opened.

Figure 2:
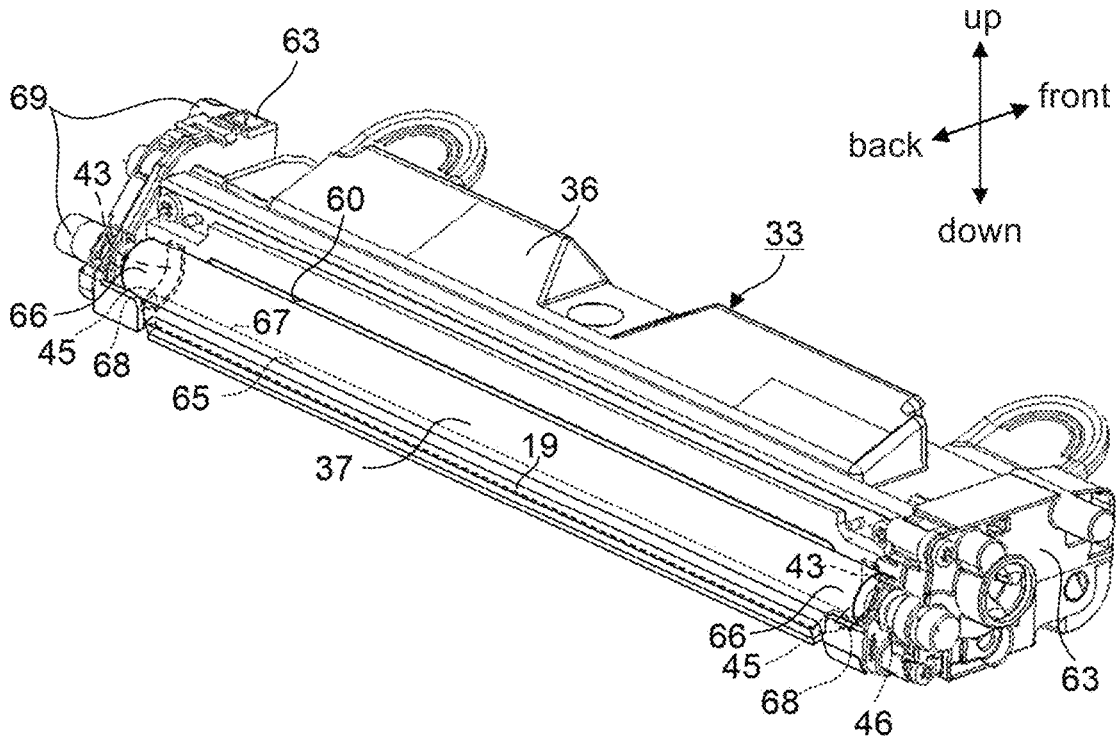
FIG. 2 is a perspective view showing a developing device in its entirety.

As shown in FIG. 1, a guide rail 18 is formed on each of a pair of side surfaces 17 opposed to the sheet width direction (a direction of the plane of FIG. 1) in the main body housing 10. The guide rail 18 has a rail structure concave in the sheet width direction. The guide rail 18 extends downward from the main body opening 15 up to a mounting position F of the after-mentioned developing device 33 in the main body housing 10, FIG. 2 is a perspective view showing the developing device 33 in its entirety. FIG. 3 is an enlarged sectional view showing, on an enlarged scale, a periphery of the photosensitive drum 31 and the developing device 33.

As shown in FIG. 1, FIG. 2, and FIG. 3, the developing device 33 includes a developing container 36, a developing roller 37 (a developer carrier), a supply roller 38, a stirring paddle 333, a bush cover 63, and a guide 69.

The developing container 36 contains inside a non-magnetic single-component developer formed only of a toner and houses the developing roller 37, the supply roller 38, and so on. The developing container 36 has a stirring chamber 335 and a container opening 60 (an opening). The stirring chamber 335 contains a developer in a stirred state.

The container opening 60 is positioned on a rear side relative to the stirring chamber 335 in the front-rear direction. The container opening 60 is a rectangular through hole open to a rear side (a side near the photosensitive drum 31) of the developing container 36. The container opening 60 is formed to be elongate in a width direction (axis direction) of the developing device 33.

The developing roller 37 is provided on an inner side of the container opening 60 so as to overlap the container opening 60. A part of an outer circumferential surface of the developing roller 37 is exposed to an outer side of the developing container 36 through the container opening 60. The developing roller 37 includes a rotary shaft 39 extending along the width direction (the sheet width direction) of the developing device 33. The rotary shaft 39 is rotatably supported to the developing container 36. In other words, the developing roller 37 is supported to the developing container 36 via the rotary shaft 39 so as to be rotatable about the rotary shaft 39. Hereinafter, a direction along the rotary shaft 39 is referred to as the "axis direction."

The developing roller 37 is capable of carrying a toner on the outer circumferential surface thereof. When the developing device 33 is at the mounting position P1, the part of the developing roller 37 exposed through the container opening 60 is opposed to the outer circumferential surface of the photosensitive drum 31 while being in contact therewith or being adjacent thereto. In this state, the developing roller 37 is capable of supplying a non-magnetic single-component toner (developer) to the photosensitive drum 31.

The supply roller 38 is provided between the developing roller 37 and the stirring paddle 333. The supply roller 38 supplies a non-magnetic single-component toner (developer) to the outer circumferential surface of the developing roller 37, The stirring paddle 333 is provided in the stirring chamber 335 and stirs a developer inside the stirring chamber 335.

The bush cover 63 is removably provided at each of both end parts of the developing container 36 in the sheet width direction. The bush cover 63 constitutes each of side walls of the developing container 36. The guide 69 is a cylindrical protrusion protruding from the bush cover 63. The guide 69 is engageable with the guide rail 18, With the guide 69 engaged with the guide rail 18, the developing device 33 is movable between the main body opening 15 and the mounting position P1 along the guide rail 18.

In a state of being mounted at the mounting position P1 in the main body housing 10, the developing device 33 supplies a toner to the outer circumferential surface of the photosensitive drum 31. In this manner, the developing device 33 develops an electrostatic latent image formed on the outer circumferential surface of the photosensitive drum 31 (forms a toner image (a visible image) by visualizing the electrostatic latent image).

As shown in FIG. 2 and FIG. 3, a restriction blade 64, a pressing member 43, a flat part 62, and a seal member 65 are provided at a periphery of the container opening 60. The restriction blade 64 is secured at an end part of the developing container 36 on the rear side thereof. The pressing member 43 is provided at each of both end parts of the developing roller 37 in the axis direction. The flat part 62 is positioned on a rear side (a side near the photosensitive drum 31) relative to the container opening 60. The seal member 65 is loaded on the flat part 62.

As shown in FIG. 3, the restriction blade 64 is provided at an upper part of an opening edge of the container opening 60 and protrudes toward the developing roller 37. A distal end part of the restriction blade 64 in a protruding direction thereof is disposed in contact with or adjacently to the outer circumferential surface of the developing roller 37. As the developing roller 37 rotates, a toner supplied onto the developing roller 37 enters between the restriction blade 64 and the developing roller 37 and is further carried on the developing roller 37 as a thin layer having a given thickness while being frictionally charged.

Figure 4:
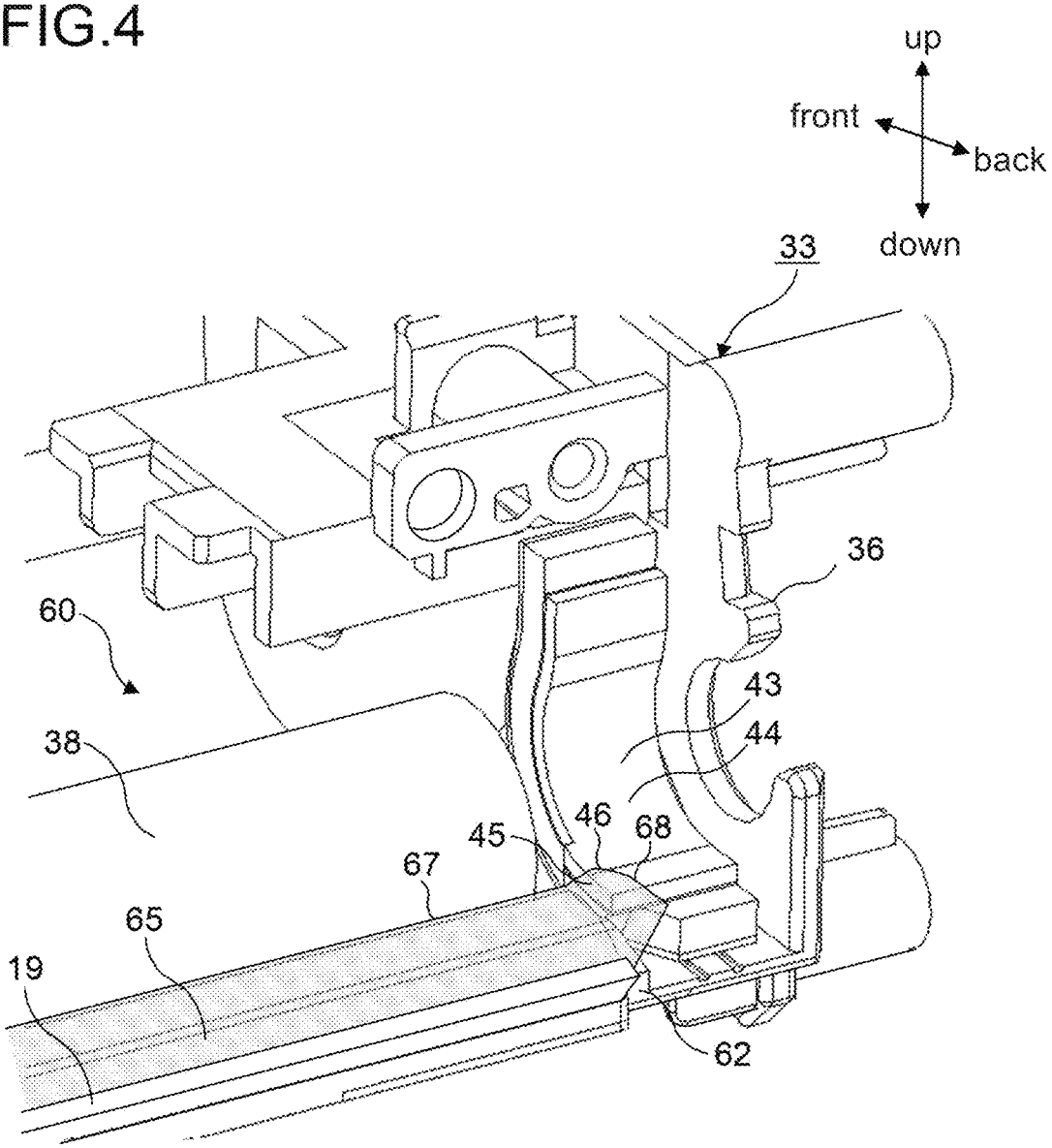
FIG. 4 is a perspective view showing the developing device in a state where a developing roller, a restriction blade, and a bush cover have been removed therefrom.
Figure 5:
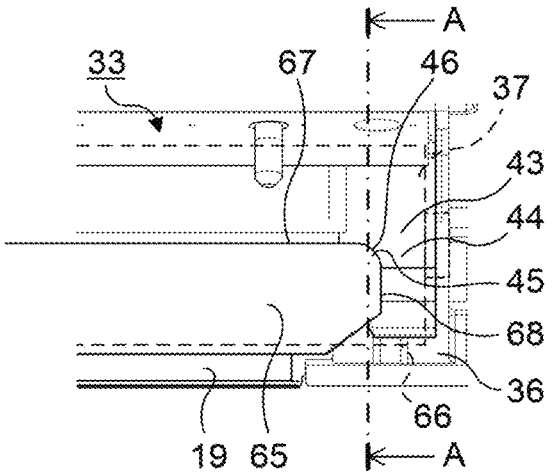
FIG. 5 is a plan view, as seen in plan from above, of the developing device in a state where the developing roller has been removed therefrom.
Figure 6:
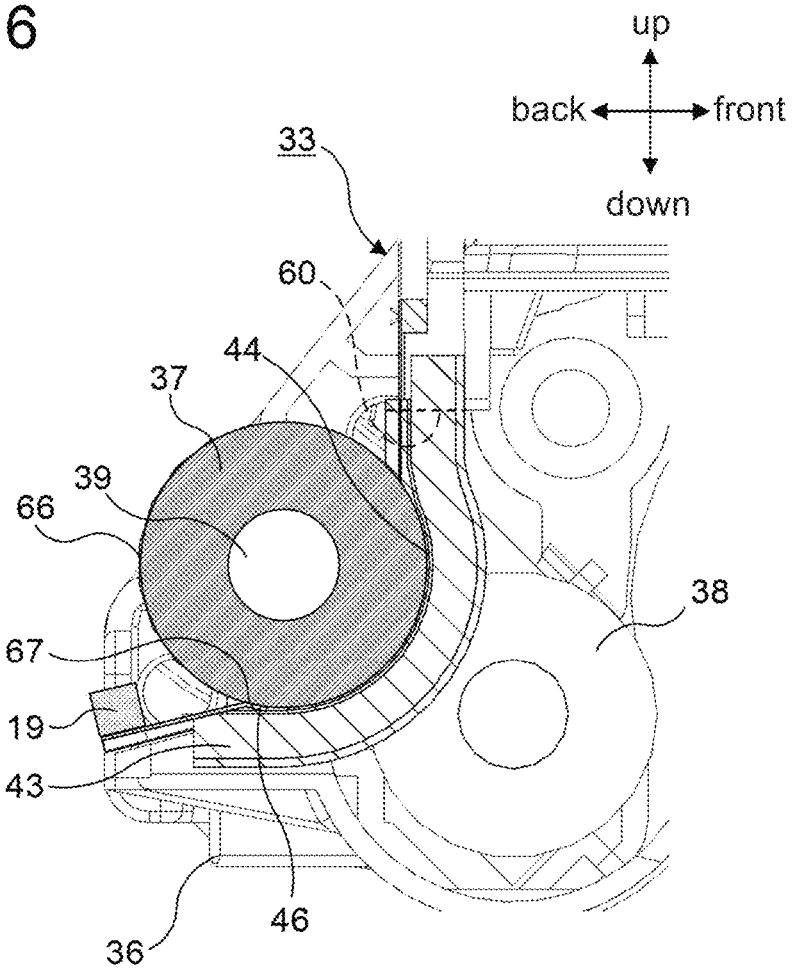
FIG. 6 is a sectional view showing a cross section of the developing device shown in FIG. 5 as cut along an A-A cross-sectional line.

FIG. 4 is a perspective view showing the developing device 33 in a state where the developing roller 37, the restriction blade 64 (see FIG. 3), and the bush cover 63 (see FIG. 2) have been removed therefrom. FIG. 5 is a plan view, as seen in plan from above, of the developing device 33 in a state where the developing roller 37 (see FIG. 3) has been removed therefrom. FIG. 6 is a sectional view showing a cross section of the developing device 33 shown in FIG. 5 as cut along an A-A cross-sectional line. In FIG. 5, a position of the developing roller 37 before being removed is shown by a broken line.

The pressing member 43 is located at such a position as to overlap each of end parts of the container opening 60 on both sides thereof in the axis direction (see FIG. 2). As shown in FIG. 4. FIG. 5, and FIG. 6, the pressing member 43 has a pressing surface 44. The pressing surface 44 is curved to be concave forward (toward the stirring chamber 335) along the outer circumferential surface of the developing roller 37. The pressing surface 44 is opposed to an outer circumferential surface of each of both end parts 66 of the developing roller 37 in a radial direction of the developing roller 37.

The pressing member 43 is formed to have a thickness larger than a gap between the outer circumferential surface of the developing roller 37 and an inner surface of the developing container 36. Thus, when the developing roller 37 is mounted in the developing container 36, the pressing surface 44 makes contact with the outer circumferential surface of the developing roller 37 and presses the developing roller 37 in the radial direction thereof. The pressing surface 44 makes contact with and presses each of the both end parts 66 so as to close a gap between the each of both end parts 66 and the developing container 36, thus suppressing an outflow of a developer from inside the developing container 36.

As shown in FIG. 3 and FIG. 4, the flat part 62 is a flat surface connected to a part of the inner surface of the developing container 36 positioned below the developing roller 37. The flat part 62 extends rearward (in such a direction as to approach the photosensitive drum 31) from the container opening 60. When the developing device 33 is at the mounting position P1, the flat part 62 lies substantially horizontally.

Referring back to FIG. 2 and FIG. 3, the seal member 65 is a rectangular sheet formed of a PET film or the like. The seal member 65 is stacked on the flat part 62 and bonded to the developing container 36 with an adhesive or the like. The seal member 65 extends between the both end parts 66 of the developing roller 37 along the axis direction.

The seal member 65 includes a contact end part 67, a blocking part 19, and an interposed end part 68. The contact end part 67 is one of both end edges of the seal member 65 in the front-rear direction (a direction orthogonal to the sheet width direction) on a side near the developing roller 37 (the supply roller 38). The blocking part 19 rises up from the other end edge of the seal member 65 on a side distant from the developing roller 37 (the supply roller 38) along a surface direction of the seal member 65. The interposed end part 68 is positioned at each of both end edges of the seal member 65 in the axis direction.

The contact end part 67 is positioned between the developing container 36 and the developing roller 37 (see FIG. 6). The contact end part 67 is in contact with an entire developer-carrying region of the outer circumferential surface of the developing roller 37 in the axis direction. As a result of the contact end part 67 being in contact with the outer circumferential surface of the developing roller 37, the seal member 65 closes a gap between the developing container 36 and the developing roller 37, thus suppressing outflow of a developer in the developing container 36.

The blocking part 19 is made of sponge or the like and has a quadrangular shape. The blocking part 19 is bonded to a surface of the seal member 65 with an adhesive or the like. The blocking part 19 retains a slight amount of developer that has flowed out through a gap between the developing roller 37 and the developing container 36, thus preventing it from dropping outside the developing device 33.

As shown in FIG. 4 and FIG. 5, the seal member 65 is disposed to extend from its center part to each side in the axis direction toward the interposed end part 68 so as to ride on the pressing surface 44 of the pressing member 43 from the flat part 62.

A chamfered shape 46 is formed at a corner 45 positioned between the contact end part 67 and the interposed end part 68. The chamfered shape 46 has a circular arc shape formed by R-chamfering. The corner 45 is interposed between the outer circumferential surface of the developing roller 37 and the pressing surface 44 of the pressing member 43. When the developing roller 37 rotates, the outer circumferential surface of each of the both end parts 66 of the developing roller 37 slides over the corner 45 of the seal member 65.

Since the seal member 65 and the pressing member 43 are provided, it is possible to suppress an outflow of a developer in the developing container 36. Further, the chamfered shape 46 is formed at the corner 45 between the contact end part 67 and the interposed end part 68 of the seal member 65. This reduces a contact area between the corner 45 of the seal member 65 and the developing roller 37 and thus reduces a frictional force acting on the corner 45. As a result, the corner 45 of the seal member 65 is unlikely to vibrate. Thus, end parts of the seal member 65 are unlikely to vibrate. Accordingly, it is possible to provide the developing device 33 capable of suppressing noise and degradation of the seal member 65 while maintaining a sealing property with respect to a developer.

Furthermore, as described above, the guide rail 18 extends downward from the main body opening 15 up to the mounting position P1 of the after-mentioned developing device 33 in the main body housing 10. Because of this, in mounting the developing device 33 in the image forming apparatus 1, when the developing device 33 is moved over the guide rail 18 to the mounting position P1, the container opening 60 may face downward. This leads to a fear that a slight amount of developer that has flowed out through the container opening 60 is spilled into the main body housing 10. Here, as described above, the blocking part 19 is provided on a rear side relative to the container opening 60 so as to rise up from the end edge of the seal member 65 along the surface direction of the seal member 65. A slight amount of developer that has flowed out through the gap between the developing roller 37 and the developing container 36 is retained by the blocking part 19, thus being prevented from dropping outside the developing device 33. Thus, even when the container opening 60 faces downward, a developer that has flowed out through the container opening 60 can be held back by the blocking part 19. Accordingly, it is possible to suppress spilling of the developer into the main body housing 10.

Other than the above, the present disclosure is not limited to the foregoing embodiment and can be variously modified without departing from the spirit of the present disclosure. For example, while the foregoing embodiment describes a monochrome printer as an example of the image forming apparatus 1, the present disclosure is applicable also to, for example, a tandem color printer or a rotary color printer. Furthermore, the present disclosure is applicable also to an image forming apparatus such as a copy machine, a facsimile, or a multi-functional peripheral having functions thereof.

Figure 7:
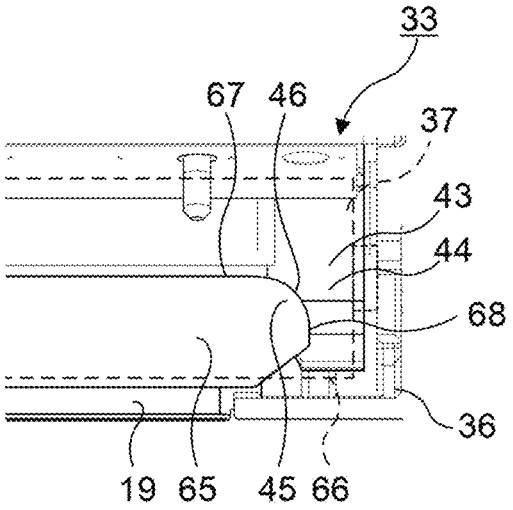
FIG. 7 is a plan view showing another example of the developing device of the present disclosure.

Furthermore, as shown in FIG. 7 (a plan view showing another example of the developing device 33 of the present disclosure), the chamfered shape 46 can be configured to be formed, in the axis direction, at least between a part of the contact end part 67 on an outer side of the pressing member 43 and the interposed end part 68. In this case, a radius of curvature of the chamfered shape 46 can be relatively increased, and thus a contact area between the seal member 65 and the developing roller 37 is further reduced. It is, therefore, possible to favorably suppress noise and degradation of the seal member 65.

Figure 8:
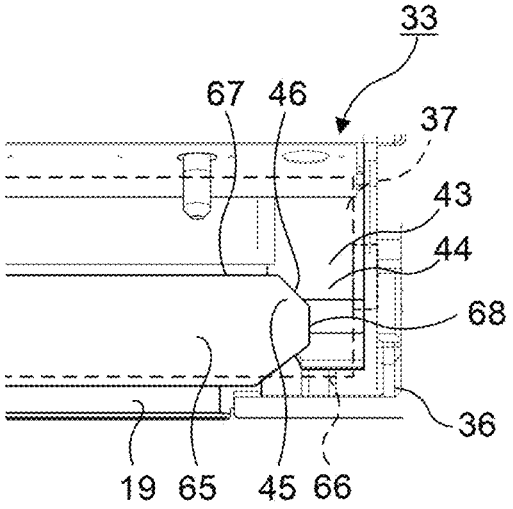
FIG. 8 is a plan view showing still another example of the developing device of the present disclosure.

Furthermore, while in the foregoing embodiment, the chamfered shape 46 has a circular arc shape (an R-chamfered shape), without being limited thereto, the chamfered shape 46 can be formed in a C-chamfered shape as shown in FIG. 8 (a plan view showing a modification example of the developing device 33 of the present disclosure).

Furthermore, while in the foregoing embodiment, the blocking part 19 is made of sponge, without being limited thereto, the blocking part 19 may be made of any other material. Furthermore, the blocking part 19 can also be configured to be integrally formed with the seal member 65 and bent so as to rise upward from the end edge of the seal member 65. In this case, the number of components of the seal member 65 is reduced, and thus a manufacturing cost can be reduced.

Furthermore, while in the foregoing embodiment, a non-magnetic single-component developer formed only of a toner is used as a developer, it is also possible to employ a two-component developer using a toner and a carrier.

The present disclosure is usable in an image forming apparatus including a developing device that uses a developer including a toner to perform development. Through the use of the present disclosure, it is possible to provide an image forming apparatus capable of suppressing noise and degradation of a seal member while maintaining a sealing property with respect to a developer,

What is claimed is:

1. A developing device, comprising:

a developing container that has an opening and contains inside a developer including a toner;

a developer carrier that is rotatably supported to the developing container and has an outer circumferential surface carrying the developer, a part of the outer circumferential surface being exposed through the opening;

a seal member that is disposed along a rotary shaft direction of the developer carrier and closes a gap between the developer carrier and the opening; and a pair of pressing members that makes contact with both end parts of the developer carrier in the rotary shaft direction and the seal member so as to close respective gaps between the both end parts of the developer carrier and the developing container, wherein the seal member includes:

a contact end part that makes contact with an entire region of the outer circumferential surface of the developer carrier in the rotary shaft direction and is one of end edges of the seal member in a longitudinal direction thereof on a side near the developer carrier; and an interposed end part that is interposed between each of the both end parts of the developer carrier and a corresponding one of the pressing members and is an end edge of the seal member orthogonal to the contact end part, and a chamfered shape is formed at a corner between the contact end part and the interposed end part.

2. The developing device according to claim 1, wherein the chamfered shape is formed, in the rotary shaft direction, at least between a part of the contact end part on an outer side of the pressing member and the interposed end part.

3. The developing device according to claim 1, wherein the chamfered shape is formed in a C-chamfered shape or an R-chamfered shape.

4. The developing device according to claim 1, wherein the seal member includes a blocking part that protrudes upward over an entire region of an end edge of the seal member opposed to the contact end part.

5. The developing device according to claim 1, wherein a non-magnetic single-component developer formed only of a non-magnetic toner is used as the developer.

6. An image forming apparatus, comprising:

an apparatus main body;

an image carrier that is provided inside the apparatus main body and has an outer circumferential surface on which an electrostatic latent image is formed; and the developing device according to claim 1 that is demountably provided inside the apparatus main body and in which, in a state where the developing device is mounted inside the apparatus main body, the developer carrier is disposed in contact with or adjacently to the outer circumferential surface of the image carrier, the developing device being configured to develop the electrostatic latent image into a toner image.

* * * * *